US005516452A

United States Patent [19]

Welch et al.

[11] Patent Number: 5,516,452

[45] Date of Patent: May 14, 1996

[54] AQUEOUS RINSE - AID COMPOSITION COMPRISING A TWO - COMPONENT BLEND OF ALKOXYLATED NONIONIC SURFACTANTS

[75] Inventors: Michael C. Welch, Woodhaven; Kenneth L. Zack, Wyandotte; Suzanne M. Gessner, Ypsilanti; Glenis Roberts, Wyandotte, all of Mich.

[73] Assignee: BASF Corporation, Parsippany, N.J.

[21] Appl. No.: 261,144

[22] Filed: Jun. 14, 1994

[51] Int. Cl.[6] ..... C11D 1/825; C11D 1/83; C11D 1/831

[52] U.S. Cl. ..... 252/174.22; 252/174.16; 252/174.21; 252/550; 252/555; 252/557; 252/559; 252/DIG. 1; 252/DIG. 10

[58] Field of Search ..... 252/174.22, 174.21, 252/DIG. 1, 550, 559, 555, 557, 174.16, DIG. 10; 568/624, 622, 625

[56] References Cited

U.S. PATENT DOCUMENTS

| | | | |
|---|---|---|---|
| 2,674,619 | 4/1954 | Lundsted | 560/198 |
| 3,082,172 | 3/1963 | Temple et al. | 252/89 |
| 3,563,901 | 2/1971 | Crotty | 252/136 |
| 4,272,394 | 6/1981 | Kaneko | 252/99 |
| 4,306,987 | 12/1981 | Kaneko | 252/99 |
| 4,411,810 | 10/1983 | Dutton et al. | 252/99 |
| 4,438,014 | 3/1984 | Scott | 252/174.21 |
| 4,443,270 | 4/1984 | Biard et al. | 134/25.2 |
| 4,678,596 | 7/1987 | Dupre et al. | 252/174.24 |
| 5,200,236 | 4/1993 | Lang et al. | 427/213 |
| 5,230,822 | 7/1993 | Kamel et al. | 252/174.13 |
| 5,258,132 | 11/1993 | Kamel et al. | 252/94 |
| 5,294,365 | 3/1994 | Welch et al. | 252/174.21 |

*Primary Examiner*—Paul Lieberman
*Assistant Examiner*—A. Hertzog
*Attorney, Agent, or Firm*—Burns, Doane, Swecker & Mathis

[57] ABSTRACT

An aqueous rinse-aid composition for kitchen utensils is provided wherein an anionic hydrotrope and a blend of two specifically defined nonionic surfactants are utilized which has been shown through empirical research to surprisingly yield improved results. One of the nonionic surfactants is an alcohol alkoxylate (as defined) and the other nonionic surfactant is a block copolymer of ethylene oxide and propylene oxide (as defined). The composition is suitable for use at a temperature of up to at least 180° F. in the absence of excessive foaming, spotting and film formation. The components of the composition exhibit good compatibility during storage even if elevated temperatures are experienced thereby maintaining reliable performance upon usage. Rapid high velocity rinsing at a high temperature is made possible in the absence of deleterious foam generation to yield dishes and tableware that can be readily dried without the need for the time consuming hand removal of deleterious spots and/or film.

25 Claims, No Drawings

AQUEOUS RINSE - AID COMPOSITION COMPRISING A TWO - COMPONENT BLEND OF ALKOXYLATED NONIONIC SURFACTANTS

BACKGROUND OF THE INVENTION

Aqueous rinse-aid compositions for use in the home or in industrial/institutional applications following the washing of kitchen utensils long have been known and are commercially available. Such compositions promote rapid draining after the washing is complete and serve to yield easily dryable dishes through the modification of surface tension so that the wash liquid readily flows away. The rinse-aid compositions offer considerable savings in labor to restaurants and institutions where large quantities of dishes and tableware are routinely washed and dried as expeditiously as possible while fully utilizing the finite level of equipment and space that is available. In the past, such rinse-aid compositions commonly have included a surfactant and a hydrotrope (e.g., an anionic hydrotrope) in order to further increase the solubility of the surfactant in water. The hydrotrope commonly adds appreciably to the cost of producing the desired rinse-aid composition particularly when it is present in a large concentration. Rinsing preferably is conducted with vigor in order to increase its effectiveness, and preferably is conducted at elevated temperatures that will better facilitate the removal of remaining traces of the liquid from the surfaces of hot tableware and dishes via volatilization. Also, it is desired that the rinse-aid composition minimize the formation of visually unattractive spots and/or film on the dishes and tableware. However, vigorous rinsing conditions commonly lead to increased foaming which may promote objectionable spotting and film formation. Also, some previously available rinse-aid compositions exhibit stability problems upon storage particularly if heat such as is common in a kitchen environment is encountered prior to use. This can lead to a lack of homogeneity and erratic rinse results when the use of the resulting composition is attempted by kitchen workers without due regard to instability that may have occurred in the rinse-aid composition that is being provided for their use.

Representative nonionic surfactants are disclosed in U.S. Pat. Nos. 4,306,987; 4,411,810 and 4,438,014. Additionally, commonly assigned U.S. Pat. No. 4,272,394 discloses a surfactant composition comprising a blend of nonionic surfactants. Representative previously available rinse-aid compositions are disclosed in U.S. Pat. Nos. 3,082,172; 3,563,901; 4,443,270; and 4,678,596. See also, the article by Jay G. Otten and Christine L. Nestor, entitled "Anionic Hydrotropes for Industrial and Institutional Rinse Aids", JAOCS, Vol. 63, No. 8, Pages 1078 to 1081 (August 1986).

Commonly assigned U.S. patent application Ser. No. 08/261,145 to the same inventors as named herein entitled "Improved Dishwashing Composition Comprising a Blend of Nonionic Surfactants" is filed concurrently herewith.

It is an object of the present invention to provide an improved aqueous rinse-aid composition that is relatively stable upon storage and is suitable for use at a temperature of up to at least 180° F.

It is an object of the present invention to provide an improved aqueous rinse-aid composition that is suitable for use with vigorous application at a temperature of up to at least 180° F. in the absence of excessive foaming.

It is an object of the present invention to provide an improved aqueous rinse-aid composition wherein in a preferred embodiment the usage of a high concentration of a hydrotrope is unnecessary.

It is an object of the present invention to provide an improved aqueous rinse-aid composition that can be utilized in the absence of excessive spotting and film formation on the tableware and dishes following rinsing.

These and other objects and advantages of the claimed invention will be apparent to those skilled in the art from the following detailed description and appended claims.

SUMMARY OF THE INVENTION

It has been found that an improved aqueous rinse-aid composition suitable for use at a temperature of up to at least 180° F. in the absence of excessive foaming, spotting and film formation consists essentially of approximately 0.75 to 5 percent by weight of an anionic hydrotrope, and a blend of nonionic surfactants (i) and (ii) in a concentration of approximately 10 to 80 percent by weight, wherein (i) is an alcohol alkoxylate surfactant having a molecular weight of approximately 500 to 2,000 and the structural formula:

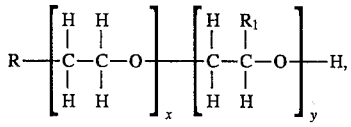

wherein R is an alkyl group of 6 to 18 carbon atoms, $R_1$ is a methyl group or an ethyl group, x is at least 3, and y is at least 2, and (ii) is a block copolymer of ethylene oxide and propylene oxide having a molecular weight of approximately 2,000 to 5,000 and the structural formula:

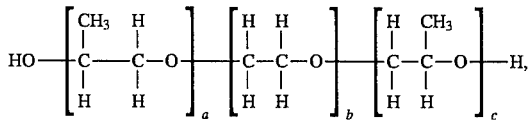

wherein a+c equals at least 20, and b is at least 20.

DETAILED DESCRIPTION

The aqueous home or industrial/institutional rinse-aid composition of the present invention constitutes an anionic hydrotrope and a blend of two specifically defined nonionic surfactants that through empirical research has been found to yield surprisingly advantageous rinse results with the absence of excessive foaming, spotting and film formation even at elevated use temperatures as discussed in detail hereafter.

The aqueous rinse-aid composition of the present invention is capable of performing well over a range of rinse temperatures including an elevated temperature of up to at least 180° F. For instance, under appropriate circumstances rinse temperatures within the range of approximately 90° F. to approximately 180° F. can be selected while utilizing the improved rinse-aid composition of the present invention.

The anionic hydrotrope commonly is provided in the aqueous rinse-aid composition of the present invention in a concentration of 0.5 to 5 percent by weight, and preferably in a concentration only 1 to 3 (e.g., 2 to 3) percent by weight. Representative anionic hydrotropes include alkylaryl sulfonates such as sodium xylene sulfonate, sodium dodecyl benzene sulfonate, linear alkyl naphthalene sulfonate, cumene sulfonate, etc.; alkyl sulfates such as sodium-2-ethylhexyl sulfate; dialkylsulfosuccinates such as sodium dihexyl sulfosuccinate; and phosphate esters. In a particularly preferred embodiment the anionic hydrotrope is sodium dihexyl sulfosuccinate. Such particularly preferred hydrotrope is commercially available as an 80 percent aqueous concentrate from Mona Industries of Patterson, N.J. under the designation of MONAWET® MM80 hydrotrope.

The first nonionic surfactant (i) is an alcohol alkoxylate having a molecular weight of approximately 500 to 2,000 (preferably 1,200 to 1,600) and the structural formula A:

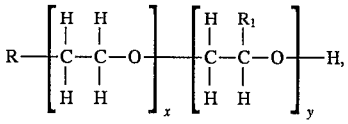

wherein R is an alkyl group of 6 to 18 (preferably 8 to 10) carbon atoms, $R_1$ is a methyl group or an ethyl group, x is at least 3 (e.g., 3 to 12), and y is at least 2 (e.g., 2 to 18).

The alkyl groups R of nonionic surfactant (i) can be branched- or straight-chained. Representative examples of preferred alkyl groups include hexyl, octyl, decyl, dodecyl, and mixtures of these, etc.

The recurring oxyethylene units in nonionic surfactant (i) designated by x are derived from ethylene oxide and impart hydrophilic moieties to the surfactant. The recurring units y are derived from propylene oxide and/or butylene oxide and impart hydrophobic moieties to the surfactant. In a preferred embodiment $R_1$ is a methyl group and the recurring units y are derived exclusively from propylene oxide.

The nonionic surfactant (i) can be formed by known techniques wherein a monofunctional initiator (e.g., a monohydric alcohol, such as octyl alcohol and/or decyl alcohol) from which the R portion of the surfactant molecule is derived is first reacted with ethylene oxide and subsequently with propylene oxide and/or butylene oxide. The recurring units x and y commonly are selected so that the weight of the oxyethylene units x constitutes approximately 25 to 45 percent by weight based upon the total weight of nonionic surfactant (i). In a preferred embodiment the recurring units x and y are selected so that the weight of the oxyethylene units x constitutes approximately 30 percent by weight based upon the total weight of nonionic surfactant (i).

Nonionic surfactant (i) preferably exhibits a cloud point of no more than approximately 20° C. Such cloud point conveniently can be determined while observing a 1 weight percent aqueous solution of the surfactant in accordance with conventional procedures.

The second nonionic surfactant (ii) is a block copolymer of ethylene oxide and propylene oxide having a molecular weight of approximately 2,000 to 5,000 (preferably 3,000 to 4,000) and the structural formula B:

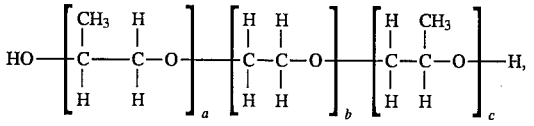

wherein the outermost blocks of the surfactant structure are derived from propylene oxide and are hydrophobic in nature, and the central block is derived from ethylene oxide and is hydrophilic in nature. In the structural formula a+c equals at least 20 (e. g., 20 to 40, and preferably 25 to 36), and b is at least 20 (e.g., 20 to 35, and preferably 22 to 32). In the structural formula a and c individually commonly are at least 10. In a particularly preferred embodiment a and c are substantially equal. Also, in a preferred embodiment the units b derived from ethylene oxide of the nonionic surfactant (ii) are present in a concentration of approximately 30 to 50 (e.g., 40) percent by weight based upon the total weight of nonionic surfactant (ii).

The nonionic surfactant (ii) can be formed by conventional techniques, such as that described in commonly assigned U.S. Pat. No. 2,674,619. Ethylene oxide can be added to ethylene glycol to provide a hydrophile of the desired molecular weight, and propylene oxide can next be added to obtain hydrophobic blocks at each end of the nonionic surfactant molecule.

Nonionic surfactant (ii) preferably exhibits a cloud point of approximately 30° to 50° C. Such cloud point conveniently can be determined while observing a 1 weight percent aqueous solution of the surfactant in accordance with conventional procedures.

The aqueous rinse-aid composition of the present invention commonly contains a weight concentration of nonionic surfactant (i) to nonionic surfactant (ii) in the blend of nonionic surfactants of approximately 2 to 5:1, and preferably approximately 4:1. During the marketing and shipment of the surfactants, the surfactant blend conveniently can be provided as a concentrated aqueous solution wherein the nonionic surfactants (i) and (ii) are provided in a combined concentration of approximately 80 percent or more by weight. Alternatively, the hydrotrope and the surfactants can be individually obtained and combined at the time of the preparation of the aqueous rinse-aid composition that is intended for use by the user.

The aqueous rinse-aid composition that is introduced into a dishwasher at the conclusion of the wash cycle commonly contains the blend of nonionic surfactants (i) and (ii) in a combined concentration of approximately 10 to 80 percent by weight, and preferably surfactants (i) and (ii) are present therein in a combined concentration of approximately 15 to 40 (e.g., 10 to 30) percent by weight. In a particularly preferred embodiment surfactants (i) and (ii) are present in a combined concentration of approximately 20 percent by weight.

Other auxiliary components commonly utilized in rinse-aid compositions may also be included in the aqueous rinse-aid composition of the present invention in a minor total concentration up to about 10 percent by weight so long as such ingredients do not interfere with the surprising benefits made possible by the hydrotrope and the blend of nonionic surfactants (i) and (ii) as discussed herein. Such optional additional ingredients include isopropanol, ethanol, propylene glycol, hexylene glycol, 1,4-butanediol, urea, chelating agents, polyacrylic acids, colorants, fragrance-release agents, etc. As indicated in the Examples, no auxiliary components need be present in improved rinse-aid composition of the present invention.

The rinse-aid composition of the present invention provides the user with a generally homogeneous and relatively stable composition even when exposed to elevated temperatures and/or vigorous rinse conditions that commonly would lead to deleterious results when utilizing many available rinse-aid compositions of the prior art. Such composition of the present invention surprisingly may be utilized at a temperature of up to at least 180° F. in the absence of excessive foaming, spotting and film formation. Kitchen utensils accordingly undergo drying in an expeditious manner to produce an attractive and acceptable product that is ready for future use with no or minimal handling by staff members. Good results are achieved even in presence of protein soil from the wash operation, such as that derived from egg and/or milk protein.

The following Examples are presented as specific illustrations of the present invention. It should be understood, however, that the invention is not limited to the specific details set forth in the Examples.

In the Examples and in the Comparative Examples test glasses initially were washed in a standard Hobart AM-11 commercial dishwasher while using a standard dishwashing composition and standard washing conditions. A composition of the following components was used to wash the dishes:

| Component | Percent by Weight Prior to Mixing With Water in Dishwasher |
|---|---|
| Sodium tripolyphosphate | 34 |
| Sodium carbonate | 18 |
| Sodium metasilicate | 25.5 |
| Sodium hydroxide (beads) | 15 |
| Sodium trichloroisocyanurate | 2.5 |
| Water | 5 |

The above-identified components were provided in the commercial dishwasher during the wash cycle in a concentration of approximately 0.23 percent by weight.

In each Example and in Comparative Example 2 during the rinse cycle a rinse-aid composition was added and was evaluated at a rinse temperature of 180° F. for foam height, and for spotting and filming. The rinse water solution was mixed with the subsequent wash cycle as is a common practice of industrial/institutional users. Also, the cloud point for the rinse aid composition was obtained in each instance. The foam height was determined by measuring the foam present inside the machine at the conclusion of the wash and the rinse cycles.

The presence of spotting and filming was determined through careful observation on a scale of 1 (no observable spots and/or film) to 5 (totally unacceptable spotting and filming) by placing dried drinking glasses that had undergone rinsing (as described) upside down in a black-lined box with a bright light source being directed from below into the mouth of each glass. In accordance with this severe test procedure for observing any spotting and filming, a value of 3 or below is considered to be acceptable for all but the most demanding usages. For a typical industrial/institutional usage a value of 3 or less is considered to be very satisfactory. Under ordinary use conditions the appearance of objectionable spotting and/or filming would not be present.

The cloud point for each rinse-aid composition was determined by observing the composition in accordance with standard test procedures.

The results observed are reported in the TABLE that follows the Examples and the Comparative Examples.

COMPARATIVE EXAMPLE 1

No rinse-aid composition was utilized and the test glasses were simply rinsed with water provided at approximately 180° F. at the conclusion of the wash cycle and were allowed to dry thereafter.

COMPARATIVE EXAMPLE 2

A rinse-aid composition was evaluated that contained 20 percent by weight of alcohol alkoxylate nonionic surfactant, 3 percent by weight of sodium dihexyl sulfosuccinate hydrotrope, and 77 percent by weight of water. The alcohol alkoxylate nonionic surfactant had a molecular weight of approximately 1,400 and corresponded to structural formula A (previously presented) for a surfactant of this type wherein R was an alkyl group of 8 to 10 carbon atoms, $R^1$ was a methyl group, x was approximately 10, and y was approximately 14. Such surfactant exhibited a cloud point of 19° C. The sodium dihexylsulfosuccinate hydrotrope was obtained from Mona Industries of Patterson, N.J. as an 80 percent aqueous solution under the designation of MONAWET® MM80 hydrotrope.

EXAMPLE 3

Example 2 was repeated with the exception that a portion of the alcohol alkoxylate nonionic surfactant was replaced by a block copolymer nonionic surfactant of ethylene oxide and propylene oxide having a molecular weight of approximately 2,500 that corresponded to structural formula B (previously presented) for a surfactant of this type wherein a+b was approximately 26, and b was approximately 23. Such surfactant exhibited a cloud point of 46° C. More specifically, the weight concentration of the alcohol alkoxylate to the block copolymer in the rinse-aid composition was 4:1.

EXAMPLE 4

Example 2 was repeated with the exception that a portion of the alcohol alkoxylate nonionic surfactant was replaced by a block copolymer nonionic surfactant of ethylene oxide and propylene oxide having a molecular weight of approximately 3,200 that corresponded to structural formula B previously presented for a surfactant of this type wherein a+c was approximately 33, and b was approximately 29. Such surfactant exhibited a cloud point of 40° C. More specifically, the weight concentration of the alcohol alkoxylate to the block copolymer in the rinse-aid composition was 4:1.

TABLE

| Number | Wash Foam Height (Inches) | Rinse Foam Height (inches) | Spotting and Filming Value | Cloud Point (°F.) |
|---|---|---|---|---|
| Comparative Example 1 | 2.0 | 1.0 | 4.5 | Not applicable |
| Comparative Example 2 | 1.0 | 0.5 | 3.0 | 117 |
| Example 3 | 0.5 | <0.2 | 2.5 | 127 |
| Example 4 | 0.5 | <0.2 | 2.5 | 147 |

It will be noted that the rinse-aid composition of the present invention surprisingly exhibits improved properties. The foam generation is insignificant thereby facilitating washing and vigorous rinsing without encountering a foam problem, the spotting and filming value is improved to a highly satisfactory level particularly for a composition that may be used in industrial/institutional applications, and the cloud point is increased thereby making possible a higher use temperature during rinsing. Such higher temperature will expedite rapid draining during the rinse step and will promote more rapid drying. Also, in view of the higher cloud point the composition of the present invention is more stable even if elevated temperatures are encountered prior to usage.

Although the invention has been described with preferred embodiments, it is to be understood that variations and modifications may be resorted to as will be apparent to those skilled in the art. Such variations and modifications are to be considered within the purview and scope of the claims appended hereto.

We claim:

1. An aqueous rinse-aid composition suitable for use at a temperature of up to at least 180° F. in the absence of excessive foaming, spotting and film formation consisting essentially of approximately 0.75 to 5 percent by weight of an anionic hydrotrope, and a blend of nonionic surfactants (i) and (ii) in a concentration of approximately 10 to 80 percent by weight, wherein (i) is an alcohol alkoxylate surfactant having a molecular weight of approximately 500 to 2,000 and the structural formula:

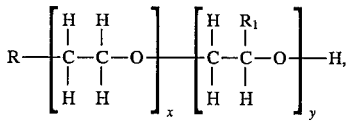

wherein R is an alkyl group of 6 to 18 carbon atoms, $R_1$ is a methyl group or an ethyl group, x is at least 3, and y is at least 2, and (ii) is a block copolymer of ethylene oxide and propylene oxide having a molecular weight of approximately 2,000 to 5,000 and the structural formula:

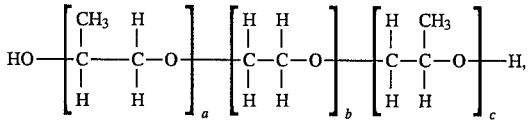

wherein a+c equals at least 20, and b is at least 20 wherein the weight concentration of nonionic surfactant (i) to nonionic surfactant (ii) in said blend of nonionic surfactants ranges from approximately 2 to 5:1.

2. An rinse-aid composition according to claim 1 that is suitable for use within the range of approximately 90° F. to approximately 180° F.

3. An rinse-aid composition according to claim 1 wherein said anionic hydrotrope is present in a concentration of approximately 1 to 3 percent by weight.

4. An rinse-aid composition according to claim 1 wherein said anionic hydrotrope is present in a concentration of approximately 2 to 3 percent by weight.

5. An rinse-aid composition according to claim 1 wherein said anionic hydrotrope is selected from the group consisting of sodium xylene sulfonate, sodium dodecyl benzene sulfonate, linear alkyl naphthalene sulfonate, cumene sulfonate, sodium- 2-ethylhexyl sulfate, sodium dihexyl sulfosuccinate, and phosphate esters.

6. An rinse-aid composition according to claim 1 wherein said anionic hydrotrope is sodium dihexyl sulfosuccinate.

7. An rinse-aid composition according to claim 1 wherein said blend of nonionic surfactants is present in a concentration of approximately 15 to 40 percent by weight.

8. An rinse-aid composition according to claim 1 wherein said blend of nonionic surfactants is present in a concentration of approximately 20 percent by weight.

9. An rinse-aid composition according to claim 1 wherein R of said nonionic surfactant (i) is an alkyl group of 8 to 10 carbon atoms.

10. An rinse-aid composition according to claim 1 wherein $R_1$ of said nonionic surfactant (i) is a methyl group.

11. An rinse-aid composition according to claim 1 wherein said nonionic surfactant (i) has a molecular weight of approximately 1,200 to 1,600.

12. An rinse-aid composition according to claim 1 wherein said nonionic surfactant (i) has a molecular weight of approximately 1,400.

13. An rinse-aid composition according to claim 1 wherein said nonionic surfactant (i) exhibits a cloud point of no more than approximately 20° C.

14. An rinse-aid composition according to claim 1 wherein x is 3 to 12, and y is 2 to 18 in said nonionic surfactant (i).

15. An rinse-aid composition according to claim 1 wherein R is an alkyl group of approximately 8 to 10 carbon atoms, $R^1$ is a methyl group, x is approximately 10, and y is approximately 14 in said nonionic surfactant (i), and the molecular weight is approximately 1,400.

16. An rinse-aid composition according to claim 1 wherein nonionic surfactant (ii) has a molecular weight of approximately 3,000 to 4,000.

17. An rinse-aid composition according to claim 1 wherein said nonionic surfactant (ii) has a molecular weight of approximately 3,200.

18. An rinse-aid composition according to claim 1 wherein said nonionic surfactant (ii) exhibits a cloud point of approximately 30° to 50° C.

19. An rinse-aid composition according to claim 1 wherein a+c is approximately 33, and b is approximately 29 in said nonionic surfactant (ii), and the molecular weight is approximately 3,200.

20. An rinse-aid composition according to claim 1 wherein a and c of said nonionic surfactant (ii) are substantially equal.

21. An rinse-aid composition according to claim 1 wherein said units b derived from ethylene oxide of said nonionic surfactant (ii) are present in a concentration of approximately 30 to 50 percent by weight based upon the total weight of said nonionic surfactant (ii).

22. An rinse-aid composition according to claim 1 wherein said units b derived from ethylene oxide of said nonionic surfactant (ii) are present in a concentration of approximately 40 percent by weight based upon the total weight of said nonionic surfactant (ii).

23. An rinse-aid composition according to claim 1 wherein the weight concentration of nonionic surfactant (i) to nonionic surfactant (ii) in said blend of nonionic surfactants is approximately 4:1.

24. An aqueous rinse-aid composition suitable for use at a temperature of up to at least 180° F. in the absence of excessive forming, spotting and film formation consisting essentially of approximately 2 to 3 percent by weight of sodium dihexyl sulfosuccinate hydrotrope, and a blend of nonionic surfactants (i) and (ii) in a concentration of approximately 20 percent by weight, wherein (i) is an alcohol alkoxylate surfactant having a cloud point of approximately 10° to 20° C., and a molecular weight of approximately 1,400 and the structural formula:

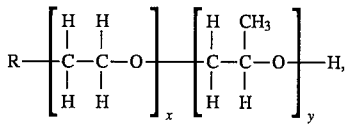

wherein R is an alkyl group of 8 to 10 carbon atoms, x is approximately 10, and y is approximately 14 and (ii) is a block copolymer of ethylene oxide and propylene oxide having a cloud point of approximately 30° to 50° C., and a molecular weight of approximately 3,200 and the structural formula:

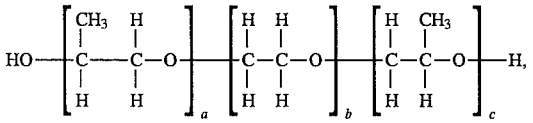

wherein a+c equals approximately 33, and b is approximately 29, and wherein the weight concentration of nonionic surfactant (i) to nonionic surfactant (ii) in said blend of nonionic surfactants is approximately 4:1.

25. The process of rinsing utensils in a machine dishwasher comprising contacting said utensils following washing with the composition of claim 1 while the temperature of said composition is within the range of approximately 90° F. to approximately 180° F.

* * * * *